US005454564A

United States Patent [19]

Kronogård

[11] Patent Number: 5,454,564

[45] Date of Patent: Oct. 3, 1995

[54] BENT SHAFT PUTTER

[75] Inventor: Håkan Kronogård, Lund, Sweden

[73] Assignee: Bengt Frejd, Skarplinge, Sweden; a part interest

[21] Appl. No.: 129,054

[22] PCT Filed: Apr. 2, 1992

[86] PCT No.: PCT/SE92/00215

§ 371 Date: Jan. 21, 1994

§ 102(e) Date: Jan. 21, 1994

[87] PCT Pub. No.: WO92/17247

PCT Pub. Date: Oct. 15, 1992

[30] Foreign Application Priority Data

Apr. 2, 1991 [SE] Sweden ..... 9100953

[51] Int. Cl.[6] ..... A63B 53/00

[52] U.S. Cl. ..... 273/81.3; 273/80 C; 273/81 B; 273/81 D

[58] Field of Search ..... 273/81 R, 81.3, 273/80 R, 80 C, 80.2, 77 R, 81 B, 81 D

[56] References Cited

U.S. PATENT DOCUMENTS

| | | | |
|---|---|---|---|
| 1,974,875 | 9/1934 | Reid | 273/81.3 |
| 2,146,048 | 2/1939 | Barnhart | 273/80 C |
| 2,212,651 | 8/1940 | Sanderson | 273/77 R |
| 2,218,268 | 10/1940 | Reid | 273/81.3 |
| 3,035,839 | 5/1962 | Coglianese | 273/80 C X |
| 3,170,690 | 2/1965 | Goranson et al. | 273/81.3 X |
| 3,326,554 | 6/1967 | Scully | 273/81.3 |
| 3,606,326 | 9/1971 | Sparks et al. | 273/81 R |
| 4,163,554 | 8/1979 | Bernhardt | 273/80 C |
| 4,227,694 | 10/1980 | Drake | 273/80 C X |
| 4,605,228 | 8/1986 | Guendling, Jr. | 273/80 C X |
| 4,979,743 | 12/1990 | Sears | 273/81 R |

*Primary Examiner*—William H. Grieb
*Attorney, Agent, or Firm*—Ladas & Parry

[57] ABSTRACT

Putter and method of using the putter by a golfer for hitting a golf ball along an intended target line. The golfer places himself in a position with his face facing the target and curves himself somewhat forwards into a relaxed position and twists around a vertical axis and/or inclines himself somewhat to the side so that the head and the eyes are positioned essentially above the target line. Then, the natural pendulum movement of the arm will be essentially parallel to the target line. The grip (12) of the putter is adapted so that when the hand grasps the grip of the putter, it does not influence upon the pendulum movement of the arm, which means that the symmetry axis of the grip comprises a backward angle relative to the vertical of between 10 and 40 degrees and an inwards angle of between 5 and 15 degrees.

11 Claims, 7 Drawing Sheets

BENT SHAFT PUTTER

AREA OF INVENTION

The present invention relates to a putter for golf and in more details to a new design of a putter and a method of using the new putter.

PRIOR ART

According to previously known technique within the golf game, there is used a particular type of golf club named putter for performing hits at the green for bringing the golf ball to the hole. The putter has a construction which in several respects differs from other golf clubs. During putting, the golf ball in all essentials always contacts the ground or the grass.

A putt is today performed so that the golfer places himself beside the golf ball with one side, usually the left side, if fight handed, facing the golf hole, essentially in the same way as with other types of golf swings, i.e. the face is perpendicular to the ball path. Then, the golf club is grasped with both hands and used for hitting the ball with a suitable start speed and direction for reaching the hole. In dependence of which speed is required, a corresponding back swing is used, i.e. the putter is brought back a certain angle and then forwards for hitting the ball.

A putt is a very delicate blow and requires a great concentration of the golfer. Any unnecessary tension in the ann or the body can disturb such a swing. Already the fact that it is required to lift the club a certain angle with both arms entails a certain tension which can be a drawback.

One of the best golfers ever, Sam Snead, used a special putter technique, placing the ball between his feet and putting the ball straight forward from his body. However, this technique was prohibited according to international Golf Rules, which requires the golfer to stand to one side of the intended ball path.

According to U.S. Pat. Nos. 2,212,651, 4,163,554 and 4,227,694 several putters are disclosed, which are adapted for straight forward putting. It is noted that all such previously known putters are used with a two-hand grip.

SUMMARY OF THE PRESENT INVENTION

The object of the present invention is to suggest a construction of a putter which makes possible that the arms and the body can be practically completely relaxed without using other forces than necessary for keeping the golfer upright.

Another object of the invention is to provide a putter, which is used with a one-hand grip and with the face essentially facing the intended ball path.

A further object of the invention is to provide a purer in which the putter grip is constructed specifically for allowing a relaxed grasp of the putter grip with one hand and to use the arm's natural pendulum movement, similar to walking.

Moreover, the object of the present invention is to provide a method of using said putter for achieving a convenient placement of the body and arm so that an unconstrained movement of the arm is permitted.

Thus, there is provided according to the invention a putter comprising a shaft, a club head and a grip, wherein the club head is attached to the shaft eccentrically and comprising a bend so that the grip of the club is positioned essentially vertically above the centre of the head, while the shaft comprises a first angle to the vertical, and the grip being conically shaped and the symmetry axis of the grip comprises a second angle to the shaft, said first and second angles being combined for providing a backward angle, for example between 10 and 40 degrees, and an inward angle, for example between 5 and 15 degrees, of the symmetry axis of the grip for providing a convenient position for the grip to be grasped by one hand of the golfer in a relaxed position. Preferably, the grip has a conical shape and the shaft is displaced within the conical shape to provide said first angle between the symmetry axis of the grip and the shaft.

Said conical shape may have the largest surface facing upwards, or the largest surface facing downwards. Said grip may comprise a bulge at the large end like a pistol grip. It is convenient if the grip comprises a flat surface essentially facing the target line. It is preferred to end the shaft in an inclined cut and that the grip is a sleeve which at the attachment at the shaft obtains said second angle in relation to the shaft.

The head of the club may be provided with aiming lines, which are hidden completely or partially by the shaft when the club is correctly alined and hangs freely with its mass centre straight below the hand grip, and which during the swing gives the golfer an indication if the club is moving along the correct hit line. It is advantageous if the grip is provided with a lining of a foamed polyurethan material with open cells.

According to the invention, there is also provided a method of using the putter by a golfer for hitting a golf ball along an intended target line. First, the golfer places himself in a position with his face in the target direction, and curves himself forwards in a relaxed position. Secondly, the golfer rotates himself around a vertical axis and/or twists himself somewhat to the side so that the head and eyes are positioned essentially above the target line and the natural pendulum movement of the arm at and around the shoulder joint is essentially parallel to the target line. Then, the golfer grasps the putter by the thumb and forefinger and the remaining fingers in a relaxed position which essentially does not influence the pendulum movement of the arm, and performs a pendulum movement of the arm backwards and forwards for hitting the golf ball. It is preferred that the pendulum movement backwards is initiated by a pressure by the thumb on the grip of the putter.

SHORT DESCRIPTION OF THE DRAWINGS

The invention is described in more details below with reference to preferred embodiments and with reference to the appended drawings, in which.

DETAILED DESCRIPTION OF THE INVENTION

It is mentioned that the normal golf swing is relatively unsuitable for putting. Many golfers places great demands in training a golf swing which can result in 200 meters ball path but forgets the importance of the putter. It is however realized that a missed putt is equally important for the end result.

According to the present invention there is used a completely different movement which can be performed essentially without tensions, viz. a pendulum movement in which the arm moves from a position behind the body and forwards. Such a movement makes it possible for the golfer to place his face against the goal, which makes easier the aiming.

The object of such a placement and movement is to use the most normal pendulum movement of the arm, viz. the same movement as when walking. In order to be able to use such a pendulum movement, the purer must be constructed so that the club head is facing forwards instead of to the side as the putters of today. The direction of movement of the putter according to the invention will be called straight forward putting.

Figure 1:
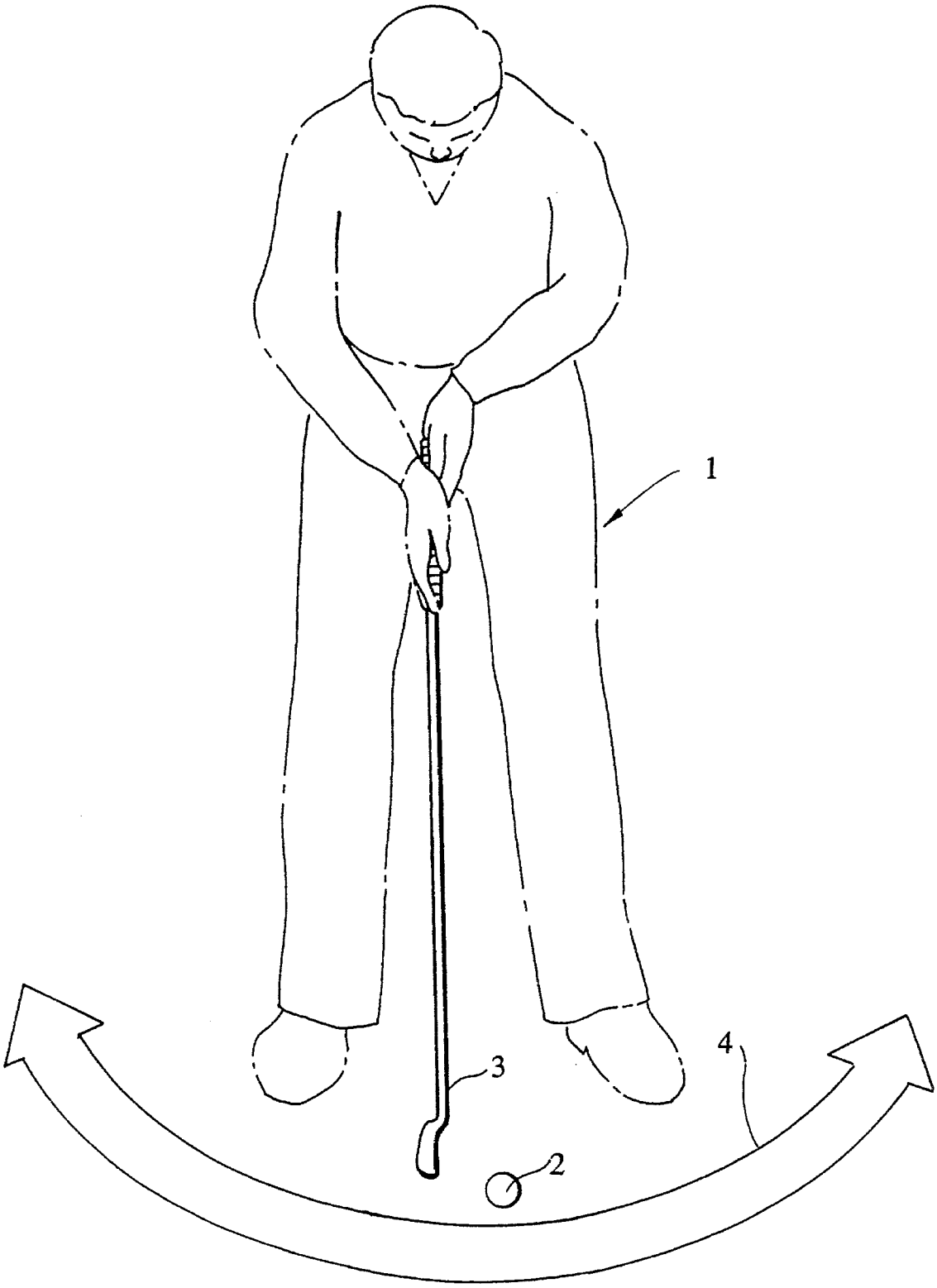
FIG. 1 is a perspective view of a golfer performing a put according to previous technique.

In FIG. 1 there is shown a conventional putting in which the golfer's face is perpendicular to the intended bail path. The golfer 1 places himself to one side of the ball 2 and with the putter 3 grasped with both hands. The arrow 4 indicates the movement of the club during the swing.

Figure 2:
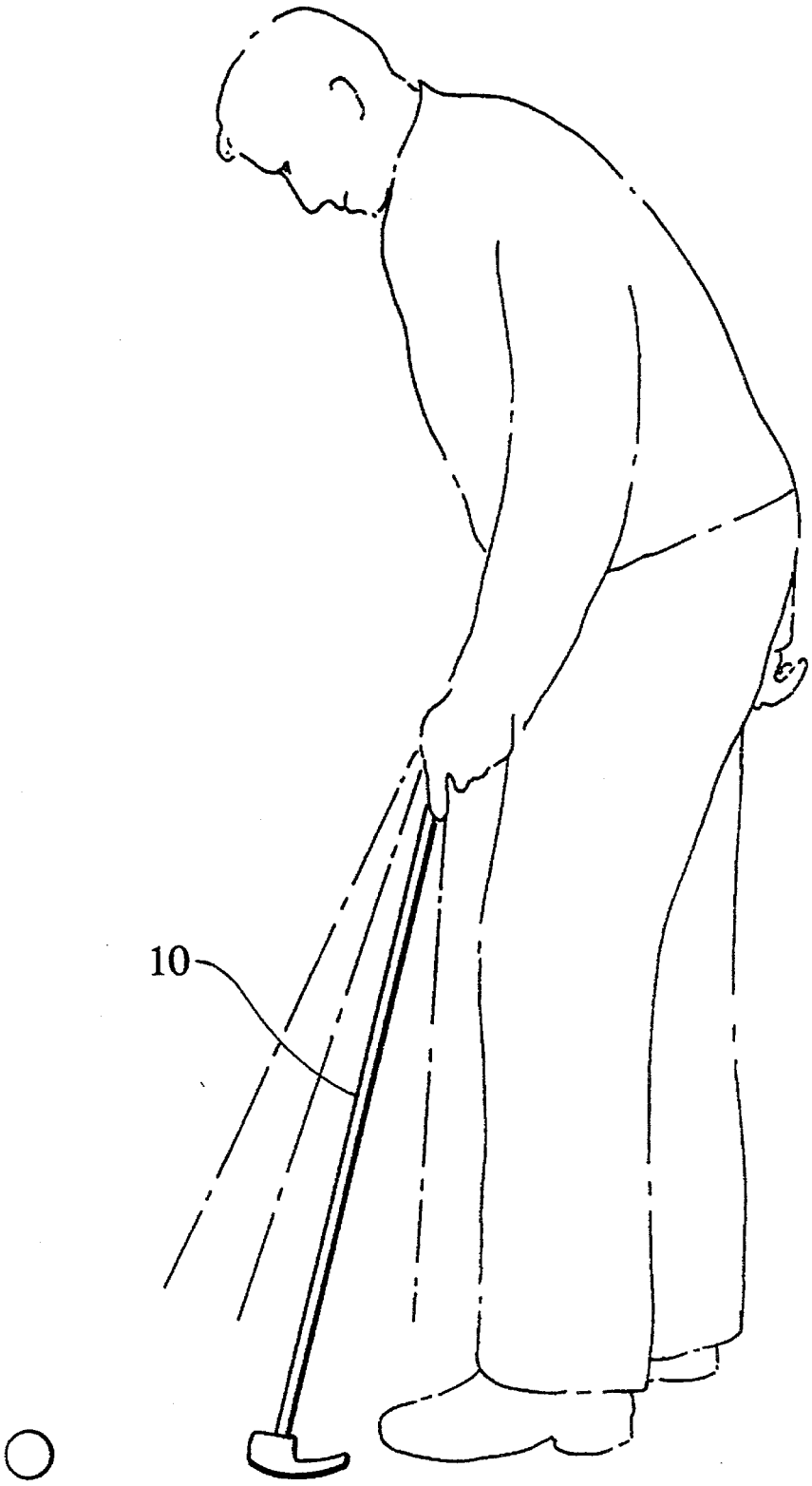
FIG. 2 is a side view in perspective of a golfer performing a put according to the present invention.

In FIG. 2 there is shown a putting according to the present invention. A putter 10 according to the invention is gasped by one hand and the golfer places himself in the same direction as the intended bail path. The arm is essentially straight and moves in the same direction as the movement when walking.

Figure 3:
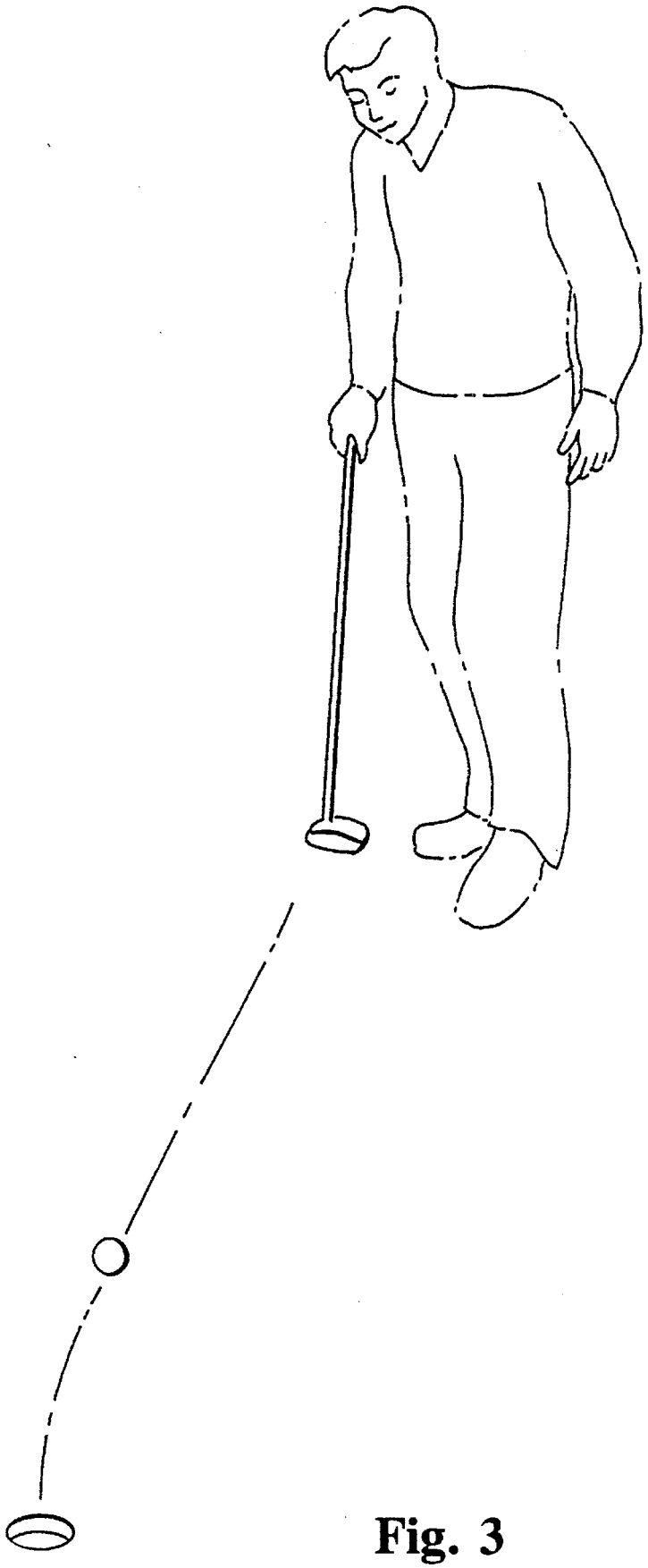
FIG. 3 is a perspective view similar to FIG. 2 but from a different direction.

In FIG. 3, the same situation as in FIG. 2 is shown but from the front. A way to achieve the position shown in FIGS. 2 and 3 which is suitable for the putter according to the invention is to use the following movement scheme. First the golfer places himself beside the ball with both feet at the same side of the ball and with the face facing the hole. Then, he bends himself somewhat forwards until the back and shoulder portions feels completely relaxed and at the same time, the knees are bent to prevent tensions in the legs and hip.

One finds that the arms now hang straight and freely before the body and are free to oscillate around the shoulder joint. However, the shoulder joint is constructed so that the oscillating movement takes place inwards like a skater and not parallel to the target line.

In order to obtain a natural pendulum movement parallel to the target line, the body must be twisted to the right, whereupon the head and shoulder move outside the support surface of the body and above the target line. The body is twisted to such an extent that the pendulum movement of the arm will be parallel to the target line, which may be around 30°. It can also be necessary to incline the body somewhat to the right for the arm to be free from the legs. Moreover, the head is rotated backwards and moved so that the eyes will be positioned above and parallel to the target line.

Then, the purer is positioned so that the purer head is perpendicular to the bail and the club is moved backwards and then forwards as far and with a speed required for the intended swing. The club is held with one hand only. It is important that the club in the very hit moment is not influenced by any forces from the arm but the hit must be completely clean so that the inertial energy of the club head is transformed to the ball.

It is advantageous if the eyes and the shoulder are positioned right above the target line for the golf ball.

It is realized that the above-mentioned position can be taken directly without following the above-mentioned movement sequence. It is important that the natural pendulum movement of the arm follows the direction of the target line and that the same position is taken by the body each time so that the putt will be carefully controlled, repeatable and predictable.

Figure 4:
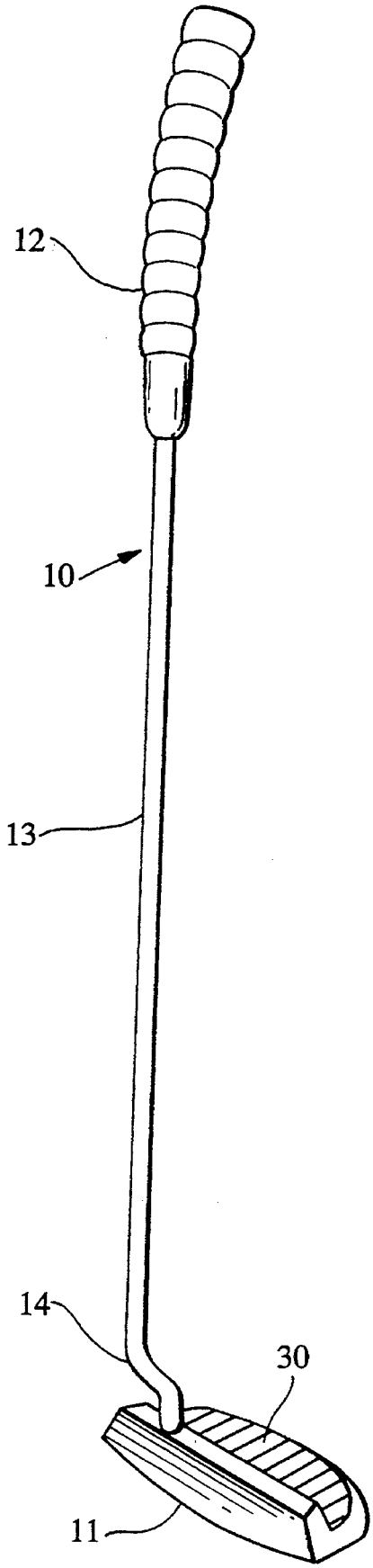
FIG. 4 is a perspective view of a putter according to the invention.

One design of the purer according to the invention is shown in FIG. 4. The putter comprises a head 11, a hand grip 12 and a straight shaft 13 interconnecting the head and the grip. The lower part 14 of the shaft is bent as shown and as will be described in more details below. The grip 12 is constructed in a specific way according to the invention in order to adapt the putter to the method of using it according to the invention.

It is mentioned that the head and shaft can be constructed in any conventional manner within the intentions mentioned below. Thus, the head can have any suitable construction so that the hit point or "sweet" point of the head is made perfect. This can imply mass concentrations at the heel and toe portions of the club head as is well-known.

Figure 5:
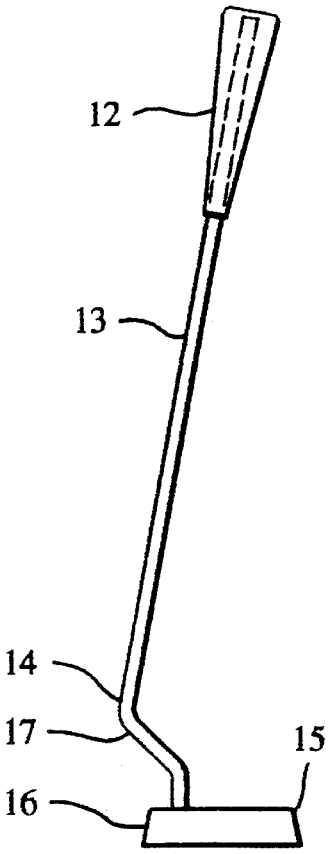
FIG. 5 is a front view of the putter according to FIG. 4.

If the arm hangs right downwards with a purer in the hand, there is a tendency for the putter to come too near the foot and the leg of the golfer, whereby there is a risk that the club will hit the foot or the knee of the golfer. There is not enough place for the pendulum movement of the arm and the purer. In order to overcome this drawback, the club head 4 of the purer is eccentrically attached to the shaft at the outer end of the club head, c.f. FIG. 5.

As appears from FIG. 5, the shaft is attached to the club head in a position as far from the body of the golfer as possible. The club head comprises a toe portion 15 facing the body of the golfer and a heel portion 16, to which the shaft is attached. Then, the shaft 14 extends further to the left as seen in FIG. 5 and is finally bent to the right at 17 to connect to the straight portion 13 of the shaft.

It is also possible to make place for the arm by inclining the body more outwards, whereby preferably, the club head is centrally attached.

There are certain Rules which governs the design of a putter, which today are internationally accepted. According to such Rules, the axis of the shaft from the top to a point not more than 5 inches above the sole must diverge from the vertical in the toe-heel plane by at least 10 degrees when the club is in its normal address position. Moreover, a putter grip may have non-circular cross-section, provided the cross-section has no concavity and remains generally similar throughout the length of the grip. The grip may be tapered but must not have any bulge or waist.

It is noted that the lower portion of the putter satisfies such Rules, since the bent portions are at the lower 5 inches of the shaft.

For the purpose of the present invention it is essential that the grip 12 of the putter is constructed so that the putter can be grasped by one hand without any tensions appearing. In FIG. 3, the left hand of the golfer is shown in a completely relaxed position. It is noted that the fingers are slightly bent and the thumb nail faces somewhat inwards towards the body. If a club grip should be grasped by the hand simply by further bending the fingers, it is necessary that the grip extends backwards and somewhat inwards towards the body, seen from the bottom of the grip and to the top.

The natural position for the hand holding an object of the weight of the putter, is to angle somewhat outwards, as shown in FIG. 3. Therefore, the hand grip 12 should be angled somewhat inwards in order to suit the natural position of the hand. This inward angle is relatively small, e.g. between 5° and 15°, and preferably around 8°.

As appears from FIG. 4, the grip 12 is also angled backwards for suiting the normal relaxed position of the hand. This backward angle is greater than the above-mentioned inward angle, e.g. between 10° and 40°, preferably around 25°.

It is mentioned that said angles can be determined by experiments for different types of golfers and can vary somewhat in dependence of preferences of the golfer. According to experiments up to now, certain angles as mentioned above can suit relatively many golfers so that a putter with said angles can be made and suit most golfers. When the golfer becomes better, it is of greater importance that the angles are adapted to the individual golfer and then a putter can be made for that golfer.

Figure 6:
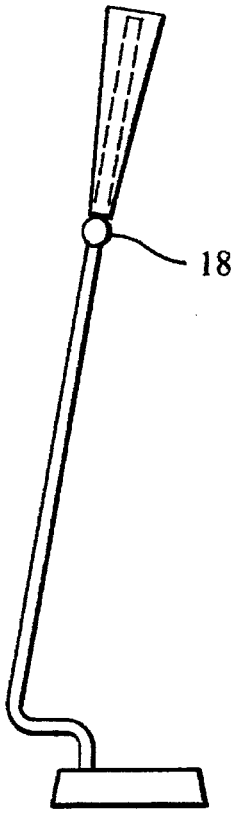
FIG. 6 is a front view of an alternative embodiment of a putter according to the invention.

The exact angles of the grip of the putter can vary from person to person. Thus, as shown in FIG. 6, it is advantageous if the putter is attached to the shaft with a universal joint 18 of the same type as used in a camera stand etc., i.e. with a possibility to adapt the angle between the hand grip and the shaft and then lock the position obtained with a lock screw. Then, each golfer can set the angle he likes himself and which suits his or her movement scheme and anatomy. Since the forces exerted on the putter are small, said technique can be used without the risk that the position is changed unintentionally during use.

However, such a club is not allowed according to said Golf Rules. Thus, such a club can only be used for evaluation purposes.

In order to achieve said angles mentioned above, which are necessary for the arm being able to follow a relaxed pendulum movement similar to the walking pendulum, it is necessary to construct the grip in a specific way.

The inward angle is easily achieved since the shaft already should have an angle of at least 10° to the vertical. This angle is obtained by the eccentric attachment of the club head as shown in FIG. 5. Since the hand grip and the mass centre of the head should be placed approximately on the same vertical, it is necessary that the the outer bend 17 is placed above the heel or even outside the heel of the head, as shown in FIG. 5.

The backward angle is more difficult to achieve. It is possible to bend the shaft forwards and than backwards again to connect to the straight portion 13 of the shaft. However, a different solution is used according to the present invention.

Figure 7:
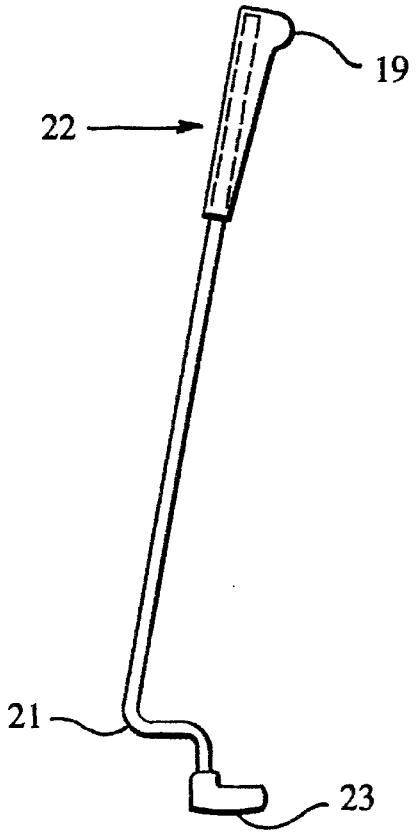
FIG. 7 is a side view of the putter according to FIGS. 4 and 5.
Figure 8:
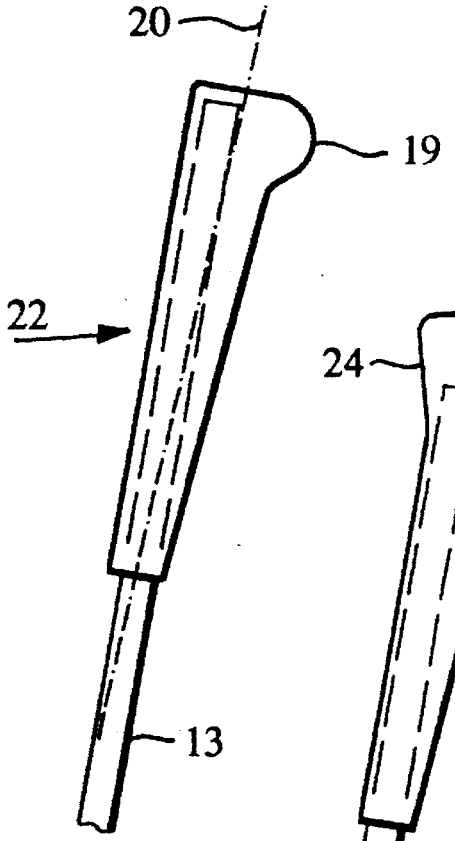
FIG. 8 is a side view of a grip according to the invention.

It is noted that there is much place in the hand between the little finger and the flat side of the hand and in order to fill that space, the grip is enlarged into a pistol grip 19 at the upper end of the grip, as clearly is shown in FIGS. 7 and 8. Then, the symmetry axis of the grip, shown by dotted line 20 in FIG. 8, has a certain angel to the shaft 13, which forms said backward angle. Said backward angle can be enlarged by bending the lower portion of the shaft at 21 as shown in FIG. 7.

When the putter according to the invention is grasped by the golfer, he takes the club shaft first between the thumb and the forefinger. In order to have in indication that the putter is held correctly, the grip may be provided with a plan surface 22, c.f. FIGS. 7 and 8, parallel with the shaft, the normal of said surface being directed against the target. The object is that the thumb shall be put at said surface 22 and the forefinger shall press the thumb securely against said surface. However, when the hand hangs along the body as according to the present invention, the normal of the thumb nail will point to the left of the target (for a right-handed person). Thus, the plan surface of the grip should, according to the present invention, be angled in exactly the same way, i.e. so that the normal of the surface points to the left of the target. Said object is obtained according to the invention by rotating the grip somewhat in relation to the shaft so that said plan surface have a desired direction. It is suitable to select said angel to around 10° but said angle is also subject to personal preferences from up to 20° and possibly down to around 5° from the target line. It is also noted that the knuckle of the hand is directed to the right and not backwards as could be seen in other designs.

If the grip is shaped as defined above, the hand can grasp the putter at the grip without unnecessary movement of the hand. The inward angle and the backward angle are obtained with a straight shaft, due to the inward inclination of the entire shaft by 10° and the pistol grip, which feels like an inclination backwards.

As shown in FIG. 7, the lower side 23, c.f. FIG. 7, of the club head is rounded so that it cannot be stopped at possible unregularities in the ground. It is realized that the risk of a stop in the ground is minimal with the putter according to the present invention since the distance from the shoulder to the ground is fixed during the entire movement since the lowest position of the club head is determined by the distance from the shoulder to the ground. A very precise hit can be obtained according to the present invention.

Figure 9:
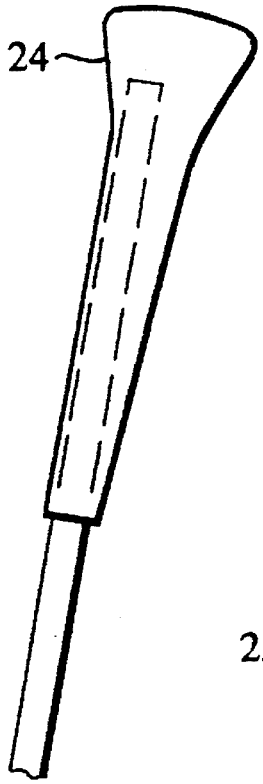
FIG. 9 is a side view of an alternative grip according to the invention.

Further adoptions of the putter to a convenient and relaxed grasp of the hand can be achieved within the scope of the present invention by forming the hand grip in different ways. In FIGS. 8 and 9 two variants are shown which can be used. The shaft is provided with a sleeve of rubber being the hand grip. Said sleeve is dimensioned with different thickness. In FIG. 8 there is shown the pistol grip 19 which is specifically suitable for the present invention. Certain golfers can also prefer that the grip is made thicker 24 at the front side as well, i.e. the side facing the hole as shown in FIG. 9.

Figure 10:
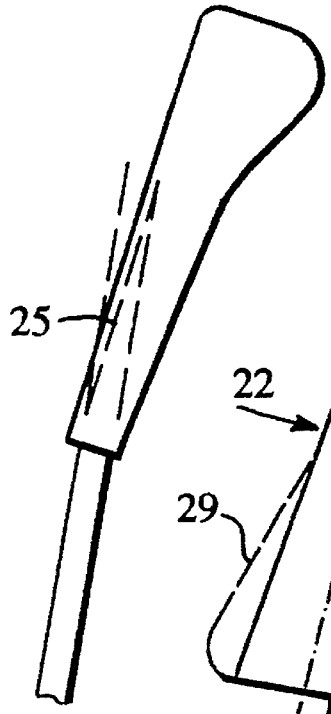
FIG. 10 is a side view of another alternative grip according to the invention.

In order to further increase the backward angle between the grip and the vertical, it is possible to cut the shaft according to an inclined line 25, as shown in FIG. 10 so that the shaft ends in an arrow. The hand grip attached to the club will then automatically have a certain angle to the grip as clearly appears from FIG. 10. Said angle is used for obtaining the backward angle according to the present invention.

Figure 11:
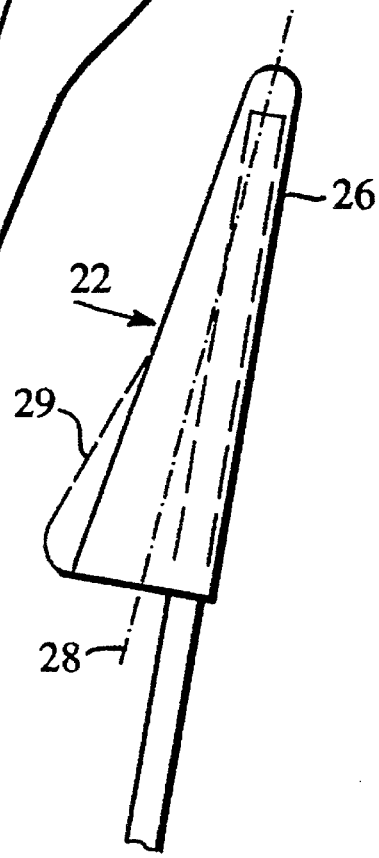
FIG. 11 is a side view of an inverted grip according to the invention.

Another design of the hand grip is shown in FIG. 11, in which the grip is shaped as a cone 26 with the large base 27 thereof being turned downwards. Also in this design is the con-shape used for inclining the symmetry axis 28 of the grip in relation to the shaft for obtaining said backward and inward angle. It has also shown convenient to add a bulge 29 for the thumb.

The putter according to FIG. 11 (and according to the preceding Figures) can be used so that the putter is grasped between the thumb and the forefinger, whereupon the other fingers grasp the grip. The putter is allowed to hang freely so that the club head is placed immediately behind the ball. Then, there is exerted a pressure by the thumb backwards, resulting in that the putter is moved backwards. Then, the pressure is released and the purer is allowed to move forwards to the ball by the gravity force to hit the ball. In this way a very relaxed swing is obtained.

Figure 12:
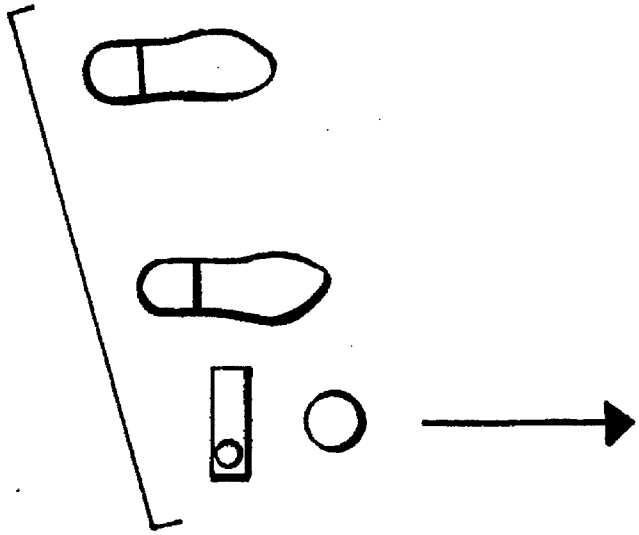
FIG. 12 is a schematic plan view of a position of the golfer when performing the swing according to the present invention.
Figure 13:
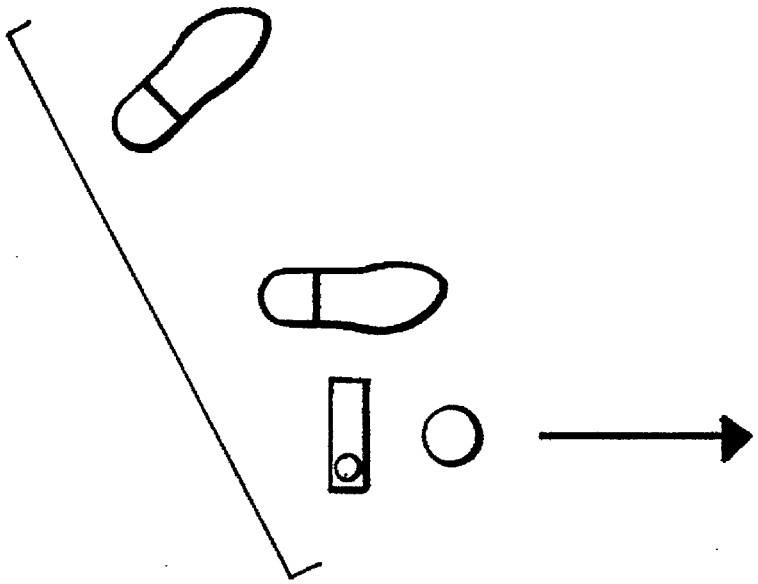
FIG. 13 is a schematic plan view of an alternative position of the golfer when performing the swing according to the present invention.

It is mentioned above a certain movement scheme for finding the correct position of the body. This position can of course be taken directly by a skilled person. It has generally shown that the position shown in FIG. 12 will suit many persons, the left foot being placed a small bit behind the right foot. In FIG. 13 it is shown that some persons may prefer to place the left foot more behind the right foot, like when playing dart or other precision sports.

According to the invention, the grip of the putter can be provided with a certain lining of a soft material, such as open-cellic polyurethan foam. Said material has the property that it adapt itself after the pressure of the fingers against the material and then maintain said form and return to the original form relatively slow. Said material can be constructed with different ability to form itself by giving the open cells of the material different sizes and with different speeds returning to the original shape. According to the present invention, the material should be relatively rigid and has a thickness of about 5–10 mm.

In order to be be still more secure that the pendulum movement according to the invention is followed, it may be suitable to provide the club head with leading lines 30, c.f. FIG. 4, which visually tells the golfer that the club oscillates in the correct direction. By providing the club head with leading lines following the shaft of the head, one will obtain a visual indication on that the club follows the correct path. Said leading lines appears as lines parallel to the shaft when viewed from above. If the club is turned backwards to the right or the left, said leading lines will be visible beside the shaft and the golfer will have an indication on that something is wrong and can put himself in a more correct position.

Still another feature is suitable to include in the club. It is suitable to shape the lower surface of the club head so that when the club is put on the green immediately behind the ball, it will stand still in a correct position. The correct position is when the mass point of the shaft and the club head is straight above each other. The only condition which must be fulfilled according to the invention is that the lower surface of the club head shall be horizontal when the club hangs in correct position in the hand of the golfer.

Hereinabove has been described some preferred embodiments of the invention in order to explain the invention, However, it is realized that the embodiments may be altered within the ideas mentioned above and it is intended the the invention should encompass also such modifications obvious to a skilled person reading this specification, The invention is only limited m the appended patent claims.

I claim:

1. A putter comprising:

a shaft;

a club head on one end of the shaft; and a grip on an opposite end of the shaft;

wherein the club head is on the shaft eccentrically in at least one of a toe-heel plane and a front-rear plane;

wherein the shaft has a bend at the one end so that the grip is positioned essentially vertically above a center of the club head when the shaft is at a first angle to the vertical; and wherein the grip is conically shaped and oriented to define a symmetry axis that forms a second angle to the shaft, said first and second angles together providing a backward angle in the front-rear plane of between 10 and 40 degrees and an inward angle in the toe-heel plane of between 5 and 15 degrees to the symmetry axis relative to the vertical, whereby to provide a convenient position for the grip to be grasped by one hand of the golfer in a relaxed position.

2. A putter according to claim 1, wherein the conical shape has a first cross section and a larger cross section father from the club head than the first cross section.

3. A putter according to claim 2, wherein the grip has a pistol-grip-like bulge at an end farthest from the club head.

4. A putter according to claim 3, wherein the opposite end of the shaft is an inclined surface and the grip is a sleeve having a symmetry axis forming said second angle in relation to the shaft by conforming to said inclined surface.

5. A putter according to claim 2, wherein the opposite end of the shaft is an inclined surface and the grip is a sleeve having a symmetry axis forming said second angle in relation to the shaft by conforming to said inclined surface.

6. A putter according to claim 1, wherein the conical shape has a first cross section and a larger cross section closer to the club head than the first cross section.

7. A putter according to claim 6, wherein the grip has a flat surface essentially facing a target line.

8. A putter according to claim 6, wherein the club head is provided with aiming lines, which are hidden completely or partially by the shaft when the club is correctly aligned and hangs freely with its mass center straight below the grip, and which during the swing gives the golfer an indication if the club is moving along the correct target line.

9. A putter according to claim 1, wherein the grip is provided with a lining of a foamed polyurethane material with open cells.

10. A putter according to claim 1, wherein the club head is provided with aiming lines, which are hidden completely or partially by the shaft when the club is correctly aligned and hangs freely with its mass center straight below the grip, and which during the swing gives the golfer an indication if the club is moving along the correct target line.

11. A putter according to claim 1, wherein the grip is provided with a lining of a foamed polyurethane material with open cells.

* * * * *